US005394716A

United States Patent [19]

Dreyer

[11] Patent Number: 5,394,716

[45] Date of Patent: Mar. 7, 1995

[54] LOCK SYSTEM

[75] Inventor: Kurt Dreyer, Volkertshausen, Germany

[73] Assignee: Maurice Ries, Allenbach, Germany

[21] Appl. No.: 946,302

[22] PCT Filed: Feb. 27, 1992

[86] PCT No.: PCT/DE92/00156

§ 371 Date: Dec. 4, 1992

§ 102(e) Date: Dec. 4, 1992

[87] PCT Pub. No.: WO92/15760

PCT Pub. Date: Sep. 17, 1992

[30] Foreign Application Priority Data

Feb. 27, 1991 [DE] Germany ..... 41 06 199.3
Jul. 16, 1991 [DE] Germany ..... 41 23 506.1
Nov. 12, 1991 [DE] Germany ..... 41 37 160.7

[51] Int. Cl.[6] ..... E05B 47/00

[52] U.S. Cl. ..... 70/276; 70/137; 292/251.5

[58] Field of Search ..... 70/276, 137, 139; 292/251.5, 201

[56] References Cited

U.S. PATENT DOCUMENTS 3,273,925 9/1966 Graham ..... 292/251.5
3,388,938 6/1968 Peterson ..... 292/251.5
3,782,147 1/1974 Hallmann ..... 70/276
3,967,479 7/1976 Vick ..... 70/276

FOREIGN PATENT DOCUMENTS 2852306 11/1979 Germany ..... 70/276
8802450 8/1988 Germany .
0247671 10/1989 Japan ..... 70/276
61190 10/1937 Norway ..... 70/276
589207 6/1977 Switzerland ..... 70/276

*Primary Examiner*—Peter M. Cuomo
*Assistant Examiner*—Darnell M. Boucher
*Attorney, Agent, or Firm*—Bachman & LaPointe

[57] ABSTRACT

The invention concerns a lock system for a door, wall, chest, safe or cupboard, etc. The lock system is covered by a cover plate and has a bolt or pin which is linked to a main lever, designed to rotate about a pivot bearing, and which operates in conjunction with a holder plate or bolt. Rotation of the main lever depends on the motion of a first magnetic block mounted on the cover plate. The main lever has at least one bore designed to accommodate at least one locking pin associated with a second magnetic block mounted on the cover plate. The second magnetic block is designed to unlock the lock by pulling the locking pins out of the bores.

18 Claims, 6 Drawing Sheets

LOCK SYSTEM

The invention relates to a lock system in a door, wall, chest, safe, cupboard or the like, which is covered by an outer plate, a locking bolt, gripper or the like, coupled to a main lever rotating about a pivot bearing, cooperating with a holding plate, a bolt or the like.

The protective function in the private and business sector is first and foremost the individual's own responsibility and therefore self-protection. Daily break-ins are increasing alarmingly despite the best-constructed and secured house entrance doors, alarm systems or the like.

A series of cylinder locks and bolt locks, in which relatively stringent safety standards are taken into account, are known as safeguards in this respect. In all these locks, however, their position is visible from outside, specifically, as a rule, as a result of the arrangement of corresponding latches, keyholes or the like. The intruder immediately knows, here, where he has to start in order to break the corresponding lock.

Alarm systems involve a high outlay and likewise do not unreservedly afford sufficient security.

The object on which the present invention is based is substantially to improve the security of a lock system.

This object is achieved in that the rotation of the main lever is dependent on the movement of a magnetic block attached to the outer plate, the main lever having at least one bore for receiving at least one retaining pin, to which a further magnetic block attached to the outer plate is assigned for the purpose of release by pulling out of the bore.

This is an invisible lock system, the position of which cannot be seen from outside. This lock system can be located at any point in a door leaf, but the door leaf is completely smooth, as seen from outside. It thus becomes extremely difficult for the intruder to determine the position of the lock system. The same is also true of the arrangement of this lock system, for example in the wall of a chest, a corresponding lid being held in the closed position by the locking system. The list of sectors or the furniture for which this lock system can be employed is only illustrative, and further possible uses also come within the scope of the invention.

The initiation of an opening or a closing operation is obtained by attaching magnetic blocks to the outer plate, these magnetic blocks performing separate functions as magnetic keys. They interact with the inner magnetic blocks.

The inner magnetic block which holds the retaining pins can be designated as the technical core of the entire system. The retaining pins are so mounted in this magnetic block that, when the outer magnetic block is attached to the outer plate, they are pulled out of the bores of the main lever. This takes place, for example, by connecting the retaining pin to a pull magnet. The return of the retaining pin into its closing position then takes place once again with the aid of a corresponding compression spring.

However, a possibility of indirect movement for the retaining pin is also possible, if the latter is connected to a push magnet via a rocker lever. The rocker lever has a fulcrum approximately centrally, so that, when the magnetic block is attached, the retaining pin is pulled out of the corresponding bore as a result of the repulsion of the push magnet.

Moreover, these bores are preferably to be arranged on segments of an arc of a circle above the pivot bearing of the main lever. The retaining pins are then also located on these arcs of a circle, so that they can engage into the corresponding bores after a specific rotation of the main lever.

In a very simple exemplary embodiment, a single retaining pin is sufficient. Even for the retaining pin there is a plurality of possible arrangements in the magnetic block. But since a lock system having a large number of locking permutations is to be produced, a multiplicity of retaining pins is provided in the magnetic block. It is possible, at the same time, both to vary the position of the retaining pins relative to one another and to alternate them with push and pull magnets or provide dummy magnets. Since a congruent and identical number of magnets has to be present in the outer magnetic block in order to pull all the retaining pins, only one quite specific coordinated magnetic block ever fits the particular arrangement of these retaining pins. The locking permutations could thereby be broadened extensively.

Whilst one magnetic block performs the release of the retaining pins, an opening or a closing movement of the main lever is brought about by means of the other magnetic block. For this, a further magnetic block, in which pull magnets are integrated, is located on the main lever. As a result of a movement of the outer magnetic block on the outer plate above the inner magnetic block, the latter is taken up and the lock system released.

However, in a preferred embodiment, no movement in the form of an arc of a circle has to be executed with the outer magnetic block on the outer plate, but a rotational movement is sufficient. For this purpose, the outer magnetic block is assigned, on a rotary shaft, an inner magnetic block, the rotational movement of which is transmitted via a rotary shaft to a spur gearwheel which itself meshes with a toothed quadrant or a rack on the main lever. A pivoting movement of the main lever is thereby executed.

There can also be provided on the rotary shaft a second spur gearwheel which cooperates with a second toothed quadrant or a second rack on a second lever. As a result of the arrangement of the two toothed quadrants above and below their respective spur gearwheel, a pincer movement of the two levers can be executed. This is expedient, above all, when the abovementioned gripper is formed directly on the lever or on the second lever.

But the gripper of one main lever can also be assigned the corresponding abutment, during a closing movement this gripper first passing through a lug in a bolt and then entering a recess in the abutment. A substantially better retention of the bolt on the gripper thereby occurs.

Furthermore, however, it is also possible for the bolt to be connected to the main lever indirectly via a pawl lever and a connecting lever. The present invention should also embrace this embodiment, and moreover a symmetrical arrangement of the two pawl levers is also possible by means of a second connecting lever.

The present lock system according to the invention also includes a corresponding magnetic key which has a special design, above all during a rotation of the magnetic block. For this, a main body carries, on one side, the outer magnetic block for the release of the retaining pins. Also formed in it on the other side is a hole, in which the other outer magnetic block can rotate. To operate the lock system, first the main body together with the outer magnetic block is attached to the outer plate for the purpose of releasing the retaining pins, and by means of its integrated magnets finds its corresponding pull magnets in the inner magnetic block and thus remains adhering to the outer plate. But it thereby at the same time gives an indication of the position of the magnetic wheel by means of the position of the hole, so that now only the second outer magnetic block need be inserted into the hole, the lock system being released or locked as a result of a rotational movement of this magnetic block. This is a highly advantageous embodiment of the invention.

So that no scratches occur on the surface of the outer plate during the rotational movement of the outer magnetic block, an air cushion is to remain between this magnetic block and the surface. This is brought about by forming an insert having an annular shoulder on the outer magnetic block, the thickness of the insert being smaller than the thickness of the main body. At the same time, the diameter of the insert is slightly smaller than the diameter of the hole.

This lock system according to the invention can also be employed in wooden doors or wooden walls which are never as conspicuous as steel doors or steel safes.

Further advantages, features and details of the invention emerge from the following description of preferred exemplary embodiments and with reference to the drawing; in this FIG. 1 shows a top view of a lock system according to the invention built into a door leaf;

FIG. 2 hows a cross-section through the lock system according to FIG. 1 along the line II—II;

Figure 1:
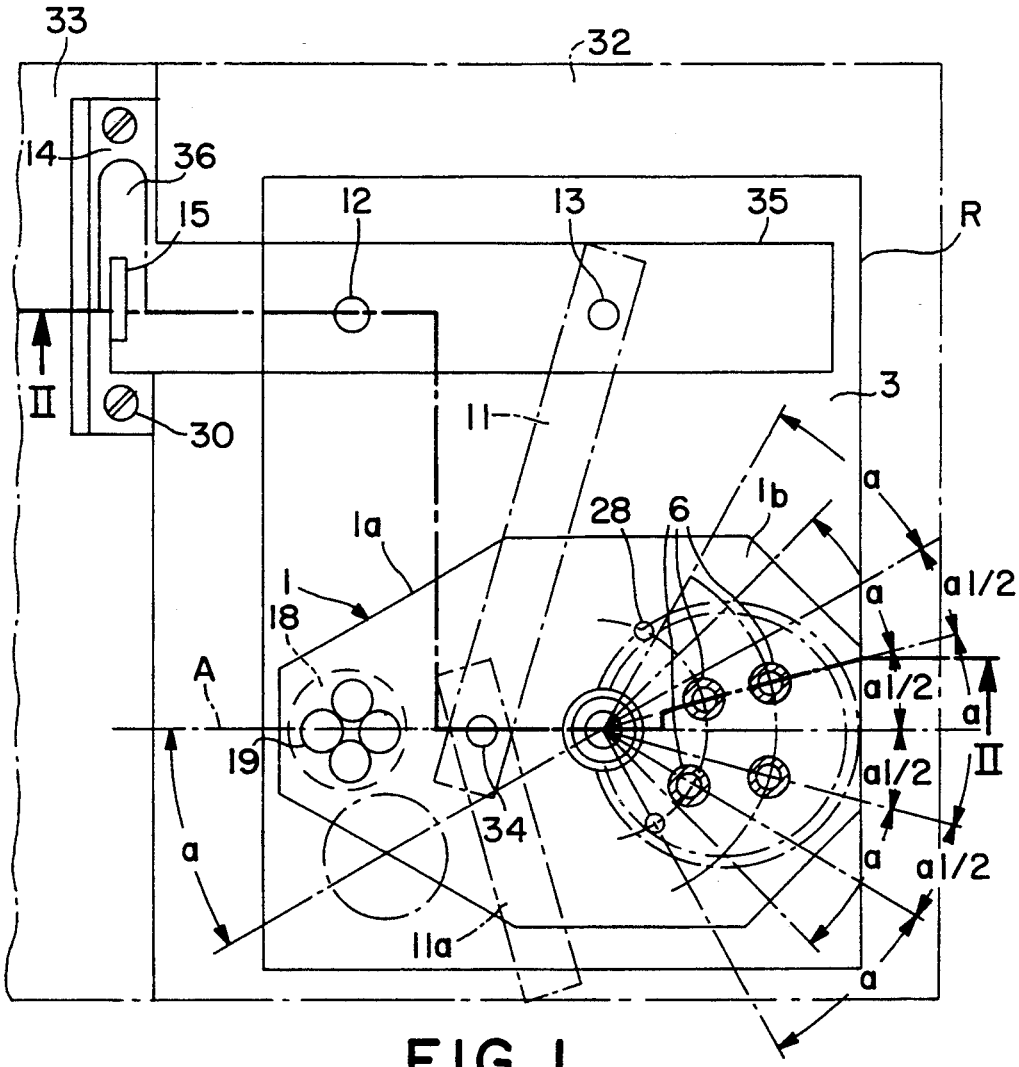

A lock system R according to the invention has a lever arrangement which is mounted ready for installation on a carrier plate 3. The carrier plate 3 is seated in a door leaf 32, its lever arrangement cooperating with a holding plate 14 in a door frame 33.

Arranged on the carrier plate 3 is a main lever 1 which is connected to the carrier plate 3 via a pivot bearing 4. This main lever 1 can rotate about the pivot bearing 4 in the direction a. The pivot bearing 4 subdivides the main lever 1 into an upper lever arm 1*a* and a lower lever arm 1*b*. Provided on the upper lever arm 1*a* is a magnetic block 18, the function of which is described later.

Between the magnetic block 18 and the pivot bearing 4 is located an articulation point 34 for a connecting lever 11 which connects the main lever 1 to a latch 35 arranged on the carrier plate 3 via a further pivot bearing 12 rotatably about this pivot bearing 12. The connecting lever 11 forms with the latch 35 a Joint point 13. During the rotation of the latch 35 about the pivot bearing 12, a locking bolt 15 can enter a locking groove 36 in the holding plate 14 or come out of it. The holding plate 14 is embedded in a door frame 33, as is not to be shown in any more detail.

The entire carrier plate 3 together with the main lever 1 and the latch 35 is inserted into the door leaf 32 and is covered by an outer plate 32*a*. The lock system R is therefore invisible from outside.

Figure 4:
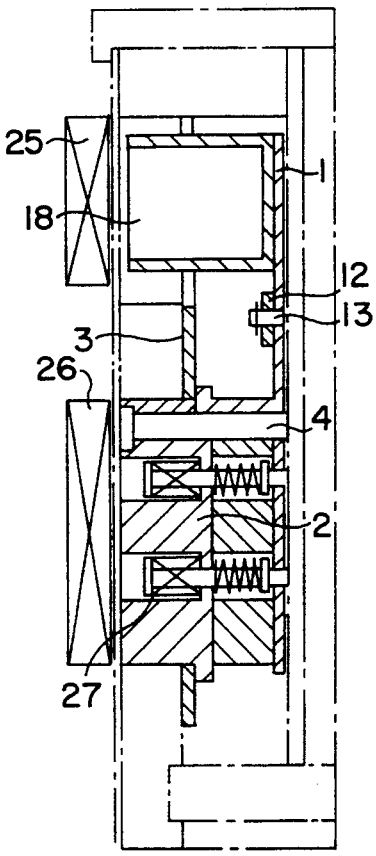
FIG. 4 shows a longitudinal section through the part of the lock system according to FIG. 3 along the line IV—IV.

To move the main lever 1, an inner magnetic block 18 is provided on the upper lever arm 1*a*. Corresponding pull magnets 19 are arranged in this magnetic block 18. A rotation of the main lever 1 about the pivot bearing 4 is brought about by a magnetic block 25, indicated in FIG. 4, which is attached to the outside of the outer plate 32*a* above the magnetic block 18 and which is pivoted in the direction a. The main lever 1 then follows this movement. The movement is transmitted via the connecting lever 11 to the latch 35 which is thus guided into or out of the locking groove 36.

Figure 2:
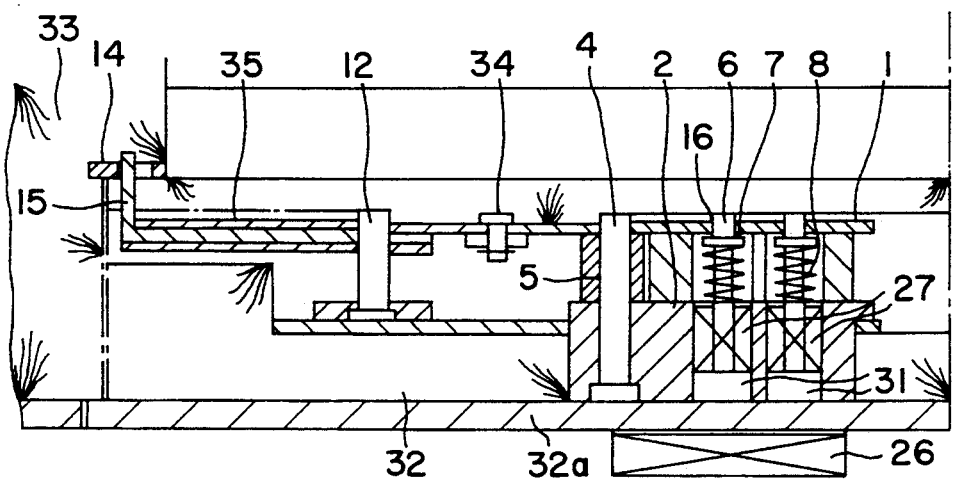

However, the opening or closing movement is possible only when retaining pins 6 are moved out of their catch positions shown in FIG. 2. In this catch position, the pins 6 engage into bores 16 of the lower lever arm 1*b* of the main lever 1 and thus prevent a rotation of this main lever 1 about the pivot bearing 4. Moreover, FIG. 2 also shows a bearing bush 5 which is pushed onto the pivot bearing 4 designed as a pivot pin and which holds the main lever 1 at a desired distance from a second inner magnetic block 2 which also receives a retaining pin 6. This magnetic block 2 is the "technical core" of the present lock system R.

The retaining pins 6 are connected to pull magnets 27 which can slide in blind-hole bores 31 in the magnetic block 2. On the other side of the blind-hole bore 31, a spring 8 is pushed onto each retaining pin 6 and is supported between the magnetic block 2 and an annular collar fixed to the retaining pin 6. When the magnetic block 26 is attached to the outer plate 32*a* for release, the pull magnets 27 are thereby attracted and the retaining pins 6 move out of the bores 16. As a result, the main lever 1 is freed. The magnetic block 26 adheres to the outer leaf of the door or of a corresponding container as a result of its magnetic effect, so that it does not have to be held further by the user. The user then merely has to feel for the magnetic block 18 with the other magnetic block 25 and pivot this magnetic block 25 in the direction a, so that the main lever 1 can rotate about the pivot bearing 4.

The opening angle a of the upper lever arm 1*a* in relation to the lower lever arm 1*b* runs by way of the pivot bearing 4 and there forms with a mid-axis A at the same angle a which is also determinant for all the intersection points occurring with the radii to the fulcrum 4. These radii are also determinant for the bores 16 in the main lever 1 and the corresponding recesses for the centering pins 6 in the magnetic block 7 and for the corresponding magnets 27.

Figure 5:
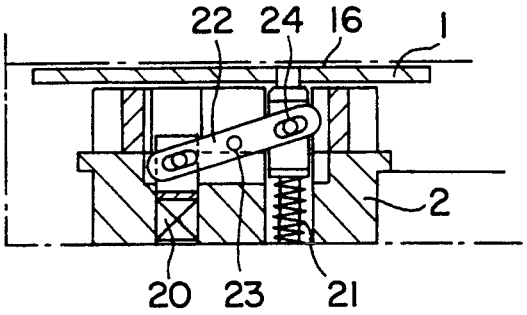
FIG. 5 shows a cross-section through the part of a lock system according to FIG. 3 along the line V—V.

In FIG. 5, an embodiment, in which push magnets 20 are used instead of pull magnets, is selected. In this, the push magnet 20 is connected in an articulated manner via a rocker lever 22 to a retaining pin 24 which itself is held via a recoil spring 21 in the closing position, that is to say retracted into the bore 16. When the push magnet 20 is repelled via the correspondingly designed magnetic block 26, said push magnet 20 lifts the retaining pin 24 out of the bore 16 via the rocker lever 22. This embodiment affords further security for the lock system R.

Figure 3:
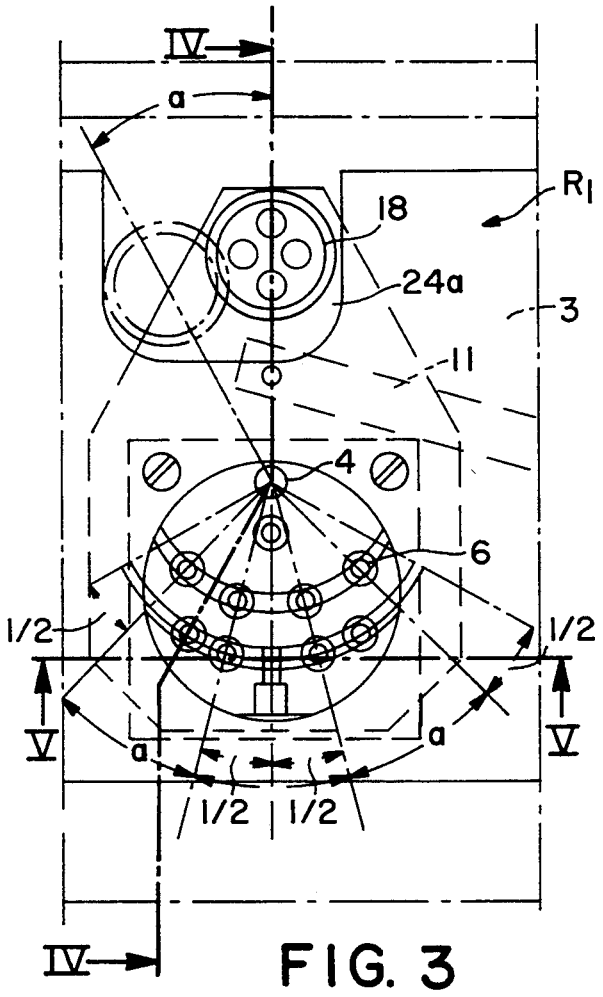
FIG. 3 shows a top view of a further exemplary embodiment of part of a lock system.

In the exemplary embodiment of a lock system R1 according to FIG. 3, six retaining pins 6, which are located on corresponding circular paths about the pivot bearing 4, are indicated instead of four retaining pins.

To stop the rotational movement of the main lever 1 or to make it possible to fix the main lever 1 in a specific position, a detent bore 28 is also preferably provided on one of the circular paths about the pivot bearing 4. That retaining pin which is likewise located on this arc of a circle about the pivot bearing 4 is caught in this detent bore 28. This position is thereby safeguarded against manual actuation.

Furthermore, FIG. 3 also indicates a recess 24*a* which is located in the carrier plate 3 and by which the rotational movement of the main lever 1 is limited. A closing position of the system is represented by unbroken lines, whilst an opening position of the magnetic block 18 is indicated by dot-and-dash lines.

The lock system acts on the bearings 4 and 12 in a freely oscillating (balanced) manner, without appreciable frictional losses; only the dead weight of the light-metal lever is to be moved by means of the magnetic effect.

Considerable numbers of locking permutations are achieved even with only a single retaining pin 6. When a multiplicity of retaining pins 6 is used, the numbers of locking permutations are sometimes exponentiated to above the million limit. In addition, further possibilities of variation can be incorporated. For example, the diameter of the retaining pins 6, 24 and the corresponding bores 16 can be made different. Also, a plurality of alternatives in respect of the magnets 19 used can be formed in the upper magnetic block 18.

A variation of the magnets in the inner magnetic blocks 2 and 18 also always necessitates a variation of the outer magnetic blocks 25 and 26 for the functionally correct fitting with the integrated individual magnets 19 and 27. Both in the lock system R and in R1, a second connecting lever 11*a* to a second latch, not shown in more detail, can also be provided, this arrangement then being made symmetrical.

Figure 6:
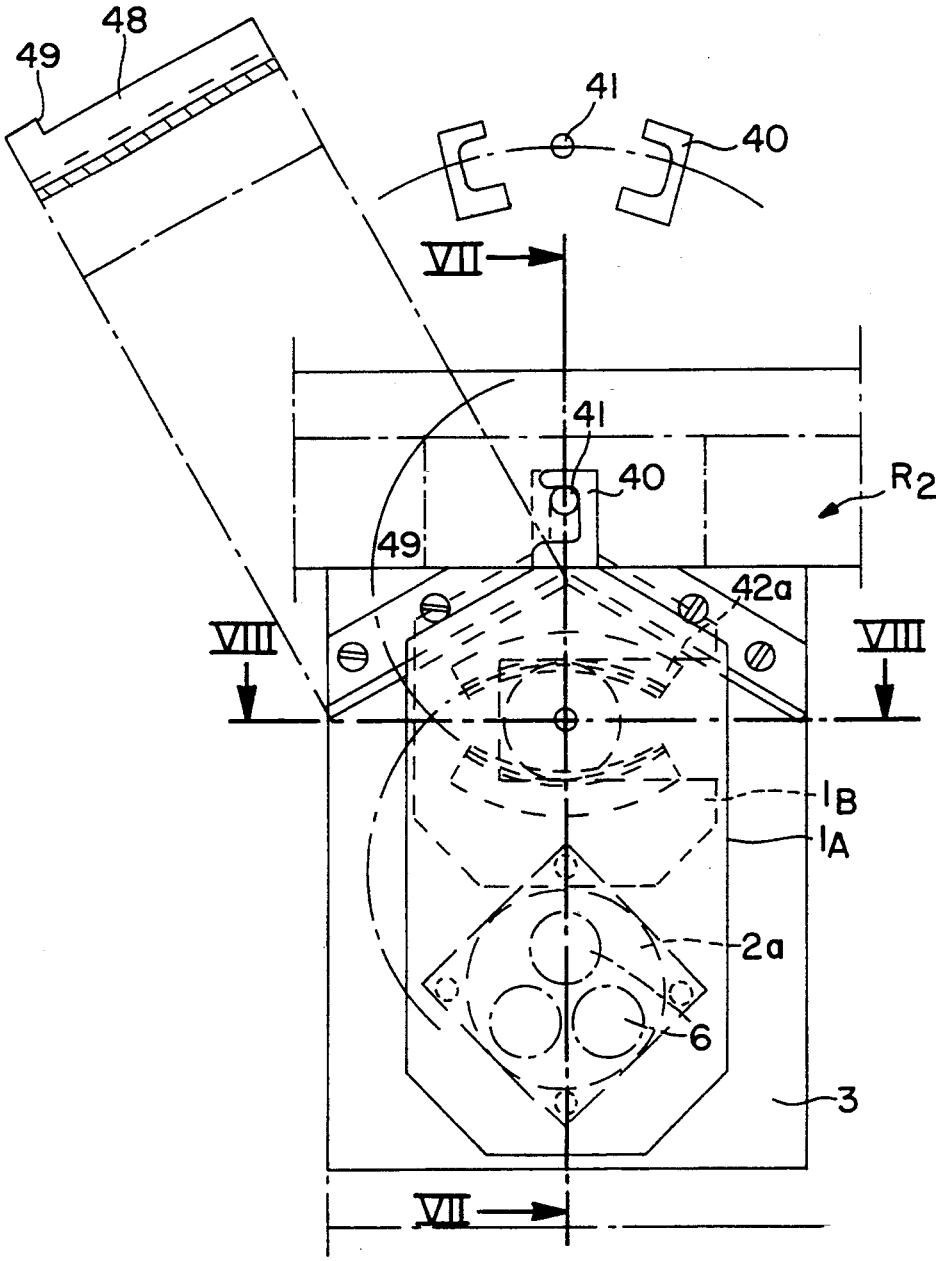
FIG. 6 shows a top view of a further exemplary embodiment of a lock system according to the invention.
Figure 7:
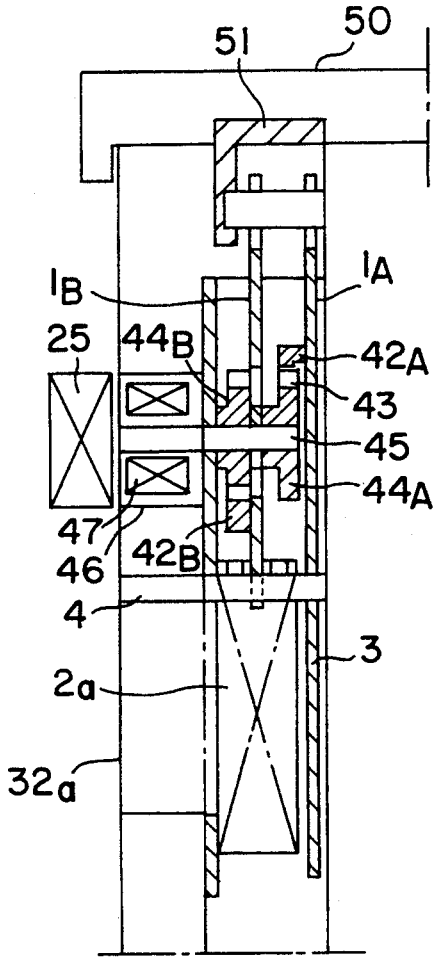
FIG. 7 shows a longitudinal section through the lock system according to FIG. 6 along the line VII—VII.
Figure 8:
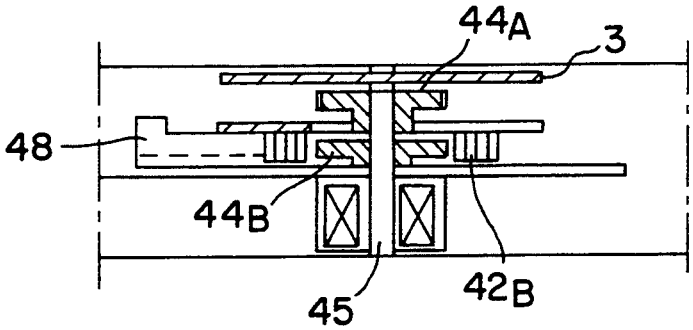
FIG. 8 shows a cross-section through the lock system according to FIG. 6 along the line VIII—VIII.

According to the further exemplary embodiment of a lock system R2 according to FIGS. 6 to 8, the main lever 1A is designed at the same time also as a latch, a gripper 40 being assigned to it. In the detent position, this gripper 40 engages over a corresponding bolt 41.

In this exemplary embodiment too, the main lever is arranged rotatably about a pivot bearing 4. The pivot bearing 4 is seated on a carrier plate 3.

On one side of the pivot bearing 4 can be seen a magnetic block 2*a* having the corresponding retaining pins 6. On the other side of the pivot bearing 4, a toothed quadrant 42A is attached to the main lever 1A. A toothing 43 of a spur gearwheel 44A engages into the toothing of this toothed quadrant 42A and is mounted on a rotary shaft 45. Seated on the rotary shaft 45 there is a further wheel 46, in which inner magnets 47 are embedded. Now when the magnetic block 25 is attached to the outer plate 32*a* above the wheel 46 and rotated, the wheel 46 also rotates, so that a magnetic coupling is obtained. The rotation of the wheel 46 is transmitted via the rotary shaft 45 to the spur gearwheel 44A, its toothing 43 rolling on the toothed quadrant 42A and pivoting the lever 1A.

In a preferred embodiment, there is also arranged rotatably on the pivot bearing 4 a second locking lever 1B, to which a further toothed quadrant 42B is attached. This toothed quadrant 42B cooperates with a further spur gearwheel 44B, specifically in the same way as the spur gearwheel 44A with the toothed quadrant 42A. This spur gearwheel 44B too is arranged on the same rotary shaft 45.

However, since the toothed quadrant 42B engages under its spur gearwheel 44B and the toothed quadrant 42A over its spur gearwheel 44A, during a rotational movement of the rotary shaft 45 a spreading apart of the main lever 1A and locking lever 1B occurs, as indicated above FIG. 6.

Moreover, an opening movement of the levers 1A and 1B is limited by a sliding shoe 48 which forms a stop shoulder 49.

Furthermore, this lock system R2 according to the invention is inserted not into a door, but into a chest, the outer plate 32*a* forming a front wall of this chest. This front wall has engaging over it a lid 50, to which the bolt 41 is also fixed via a fastening angle 51.

Figure 9:
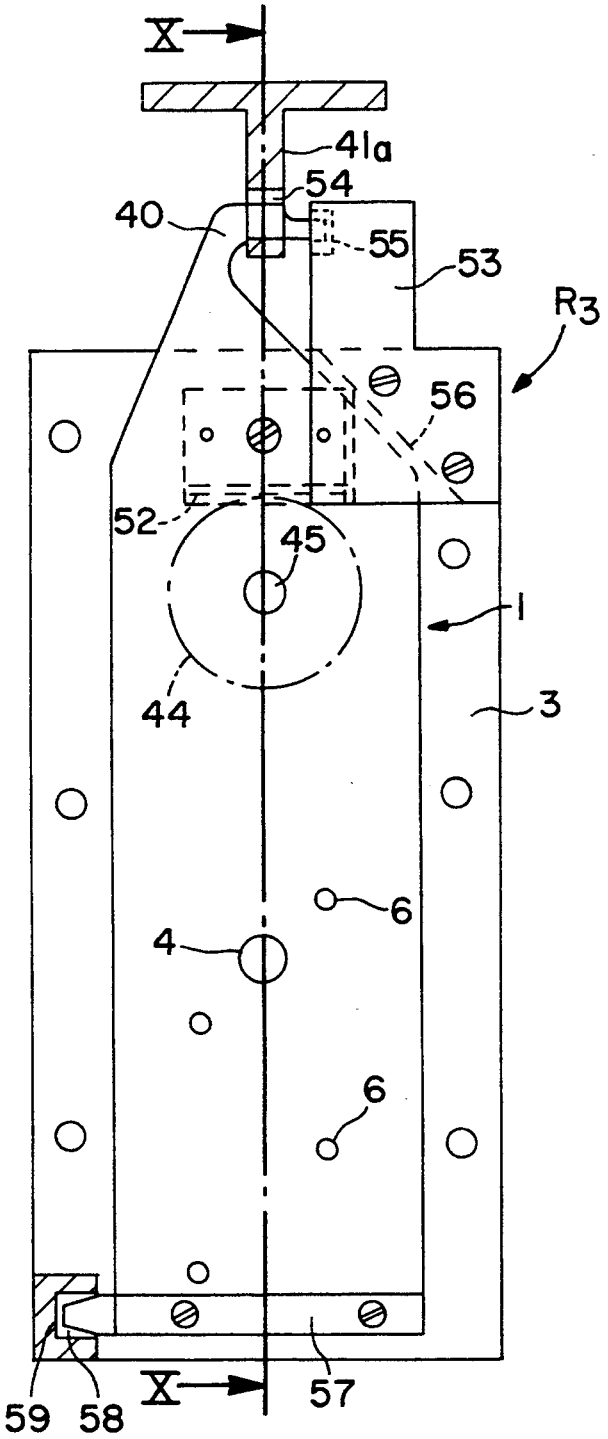
FIG. 9 shows a top view of a further exemplary embodiment of a lock system according to the invention.
Figure 10:
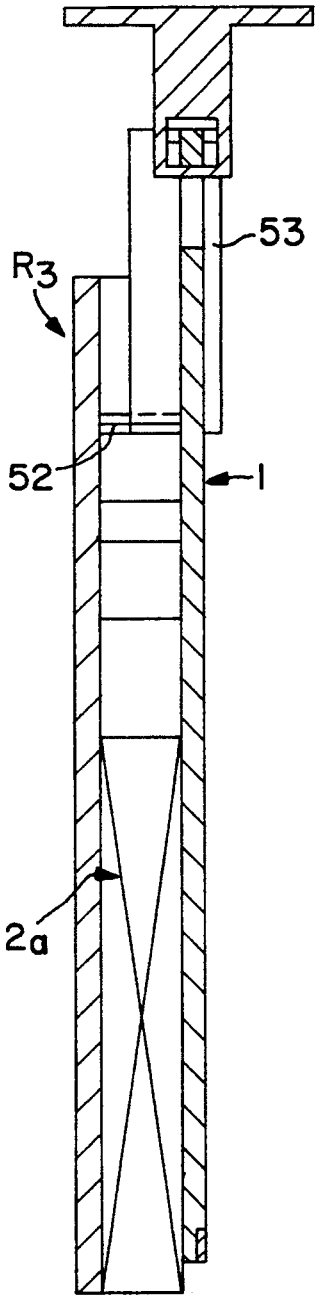
FIG. 10 shows a longitudinal section of the lock system according to FIG. 9 along the line X—X.

In the further exemplary embodiment of a lock system R3 according to the FIGS. 9 and 10, once again Only one main lever 1 is provided. After the corresponding retaining pins 6 have been pulled, this main lever 1 rotates about the pivot bearing 4, the rotational movement being brought about by a magnetic coupling such as that described in respect of FIGS. 6 to 8. The corresponding spur gearwheel 4 is assigned here a rack 52.

It is of considerable importance that the main lever 1 be assigned a hook-shaped gripper 40 which cooperates with an abutment 53. During closing, the gripper 40 passes through a lug S1 in the bolt 41*a* and engages into a recess 55 in the abutment 53. The gripper 40 is thereby especially effectively secured against being pulled. The bolt 41*a* cannot slide off from the gripper 40.

Moreover, the abutment 53 can have towards the lever an indentation 56, represented by broken lines, into which the main lever 1 slides during closing and is guided. Furthermore, there is provided, fixed to the end of the main lever 1A located opposite the gripper 40, a further locking pin 57 which, in the closing position, engages into a corresponding locking depression 58 in a counterbearing 59.

Figure 11:
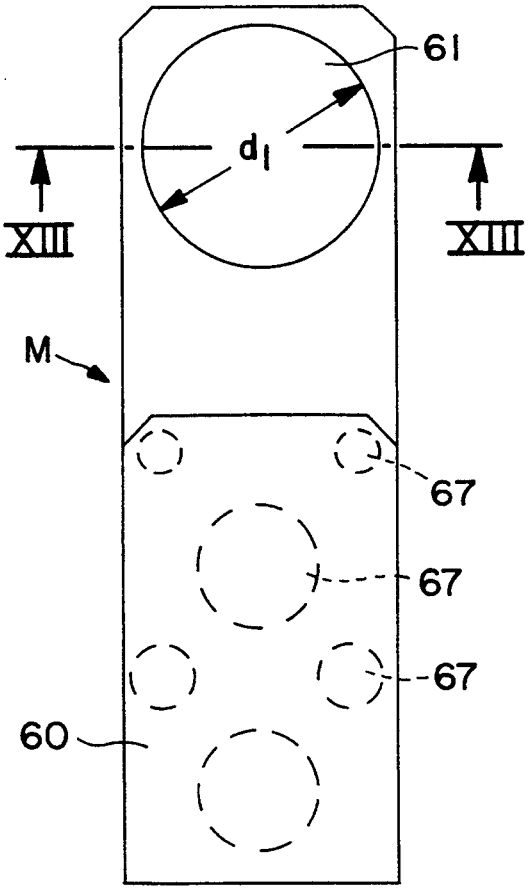
FIG. 11 shows a top view of a magnetic key according to the invention.
Figure 12:
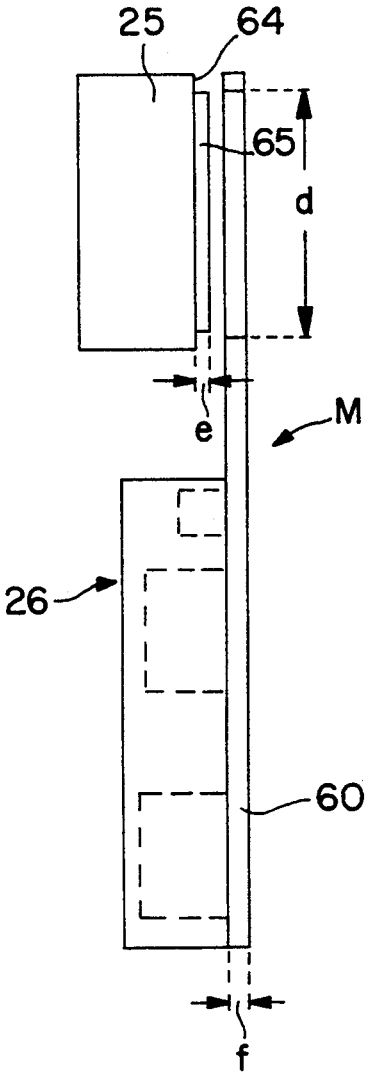
FIG. 12 shows a side view of a magnetic key according to FIG. 11.
Figure 13:
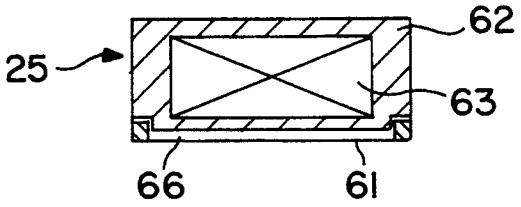
FIG. 13 shows a cross-section through the magnetic key according to FIG. 11 along the line XIII—XIII.

A magnetic key M according to the invention, as shown in FIGS. 11 to 13, can consist of wood, plastic or a metal. This magnetic key M has essentially a main body 60 which carries the magnetic block 26 at one end. At the other end, there is formed in the main body 60 a hole 61, into which the magnetic block 25 can be inserted, this magnetic block 25 rotating in the hole 61 and transmitting its rotational movement to the wheel 46. This magnetic key is suitable, above all, for the embodiments of the lock system R2 and R3.

The magnetic block 25 consists essentially of a rotary housing 62, into which a four-pole rotary magnet 63 is inserted.

It can be seen in FIGS. 12 and 13 that the rotary housing 62 forms, to produce an annular shoulder 64, a circular insert 65, the diameter d of which is somewhat smaller than the diameter dl of the hole 61. Furthermore, the thickness e is somewhat smaller than the thickness f of the main body 60, so that, after the magnetic block 25 has been inserted, the lower face of the insert 65 forms an air gap 66, for example with the surface of the outer plate 32*a*. This guarantees that the surface of the outer plate 32*a* is not damaged during the rotation of the magnetic block, so that it is also impossible to see where the magnetic block 25 has to be attached in order to rotate the wheel 44. This is important, above all, when the lock system is used in Security products, such as safes, cupboards, strongboxes, security doors or the like.

A plurality of magnets 67 and also dummy magnets can be inserted in the magnetic block 26 according to the particular system, and also the "north/south" interaction is used, likewise in relation to the particular system. As soon as the magnetic block 26 and therefore also the main body 60 has found the position of the magnetic block 2, the main body 60 remains adhering to the surface of an outer plate 32*a*, so that the rotation of the magnetic block 25 is then also possible with one hand.

It is claimed:

1. A lock system in a door, wall, chest, safe or cupboard, said lock system being covered by an outer plate and comprising:

a main lever rotating about a pivot bearing and having a first magnetic block arranged thereon, said main lever cooperating with a holding means in a surrounding structure via a latch mechanism;

said latch mechanism including a locking bolt for entering a locking groove in said holding means or a first gripper coupled to said main lever for engaging a corresponding bolt;

said outer plate having a second magnetic block attached thereto, said second magnetic block cooperating with said first magnetic block and causing through its movement rotation of the main lever;

said main lever having at least one bore for receiving at least one retaining pin;

said outer plate having a third magnetic block for pulling said at least one retaining pin out of said at least one bore;

said pivot bearing forming a mid-point for a multiplicity of circular paths on which said at least one bore moves about the pivot bearing; and said at least one retaining pin comprising a multiplicity of retaining pins along said circular paths.

2. The lock system of claim 1 further comprising:

a detent bore provided on one of said circular paths for receiving one of said retaining pins for fixing the main lever in a position other than a closing position.

3. The lock system of claim 1 further comprising:

a fourth magnetic block;

said fourth magnetic block including said pivot bearing and said retaining pins; and said fourth magnetic block further including at least one of pull magnets and push magnets for causing movement of said retaining pins.

4. The lock system of claim 3 wherein:

said third magnetic block has a number of magnets identical in number to and congruent to said magnets in said fourth magnetic block.

5. The lock system of claim 1 wherein:

said first magnetic block includes at least two pull magnets.

6. The lock system of claim 5 wherein:

said second magnetic block has a number of congruent pull magnets provided in the same number as in said pull magnets in said first magnetic block.

7. The lock system of claim 1 further comprising:

a first toothed quadrant or a first rack fixed to the main lever;

a first spur gearwheel and a magnetic wheel seated on a rotary shaft;

said first toothed quadrant or said first rack cooperating with said first spur gearwheel; and said magnetic wheel cooperating with the second magnetic block during its rotational movement.

8. The lock system of claim 7 further comprising:

a second spur gearwheel seated on said rotary shaft; and said second spur gearwheel cooperating with a second toothed quadrant or a second rack mounted to a second lever.

9. The lock system of claim 8 further comprising:

said second spur gearwheel cooperating with a second toothed quadrant; and one of said first and second toothed quadrants engaging over its respective spur gearwheel and a second of said first and second toothed quadrants engaging under its respective spur gearwheel.

10. The lock system of claim 1 further comprising:

said first gripper being formed directly on the main lever.

11. The lock system of claim 1 further comprising:

a second lever having a second gripper thereon; and said first and second grippers forming gripping pincers.

12. The lock system of claim 1 further comprising:

said corresponding bolt having a lug through which said first gripper passes; and said holding means including an abutment, whereby said first gripper enters said abutment after passing through said lug.

13. The lock system of claim according to claim 1 further comprising:

a locking pin for entering a locking depression being arranged opposite the first gripper on said main lever.

14. The lock system of claim 1 further comprising said second magnetic block rotating in a hole of a magnetic key.

15. The lock system of claim 14 further comprising said hole being formed in a main body in which the third magnetic block is also located.

16. The lock system of claim 14 further comprising:

said second magnetic block comprises a rotary housing including an insert portion and an annular shoulder surrounding said insert portion and said insert portion having a diameter slightly smaller than a diameter of a hole into which it is inserted.

17. The lock system of claim 16 further comprising:

said insert portion having a thickness smaller than a thickness of said main body.

18. The lock system of claim 15 further comprising:

magnets inserted into said third magnetic block so that the magnetic key is always fixed to the outer plate; and said magnets inserted into said third magnetic block including magnets of different sizes and dummy magnets.

* * * * *